US010443201B2

(12) United States Patent
Meindl et al.

(10) Patent No.: US 10,443,201 B2
(45) Date of Patent: Oct. 15, 2019

(54) SOIL COMPACTOR AND METHOD FOR OPERATING A SOIL COMPACTOR

(71) Applicant: Hamm AG, Tirschenreuth (DE)

(72) Inventors: Klaus Meindl, Bärnau (DE); Hans-Peter Patzner, Tirschenreuth (DE); Axel Römer, Tirschenreuth (DE)

(73) Assignee: Hamm AG, Tirschenreuth (DE)

( * ) Notice: Subject to any disclaimer, the term of this patent is extended or adjusted under 35 U.S.C. 154(b) by 0 days.

(21) Appl. No.: 15/591,148

(22) Filed: May 10, 2017

(65) Prior Publication Data

US 2017/0342668 A1 Nov. 30, 2017

(30) Foreign Application Priority Data

May 30, 2016 (DE) ..... 10 2016 109 888

(51) Int. Cl.
*E01C 19/00* (2006.01)
*E02D 3/074* (2006.01)
(Continued)

(52) U.S. Cl.
CPC ..... *E02D 3/074* (2013.01); *E01C 19/282* (2013.01); *E01C 19/286* (2013.01);
(Continued)

(58) Field of Classification Search
CPC ..... E01C 19/23; E01C 19/26; E01C 19/282; E01C 19/286; E02D 3/026; E02D 3/074; B06B 1/16
(Continued)

(56) References Cited

U.S. PATENT DOCUMENTS 3,971,788 A * 7/1976 Schwan ..... C07D 211/18 546/75
5,046,891 A * 9/1991 Vural ..... E01C 19/286 37/904
(Continued)

FOREIGN PATENT DOCUMENTS

CA 2 157 428 3/1996
CN 103603258 2/2014
(Continued)

OTHER PUBLICATIONS

German Search Report of DE 10 2016 109 888.4 dated Mar. 10, 2017, 7 pages.
(Continued)

*Primary Examiner* — Raymond W Addie
(74) *Attorney, Agent, or Firm* — Rankin, Hill & Clark LLP

(57) ABSTRACT

A soil compactor is described. The soil compactor includes at least two vibrating compacting rollers rotatable about a respective roller axis of rotation. The soil compactor further includes a vibration excitation arrangement assigned to each vibrating compacting roller of the at least two vibrating compacting rollers for generating a vibrating movement of the at least two vibrating compacting rollers. The soil compactor also includes a sensor arrangement assigned to the soil compactor for providing a feedback signal indicative of sound or a structural vibration of the soil compactor. The soil compactor yet further includes a control unit receiving the feedback signal for controlling at least one vibration excitation arrangement, based on the feedback signal, such as to act on a phase offset of the vibrating movements of the at least two vibrating compacting rollers with respect to one another.

5 Claims, 4 Drawing Sheets

(51) Int. Cl.
*E02D 3/026* (2006.01)
*E01C 19/28* (2006.01)
*B06B 1/16* (2006.01)

(52) U.S. Cl.
CPC ..... *E01C 19/288* (2013.01); *E02D 3/026* (2013.01); *B06B 1/16* (2013.01)

(58) Field of Classification Search
USPC ..... 404/72, 75, 113, 117, 122
See application file for complete search history.

(56) References Cited

U.S. PATENT DOCUMENTS 5,695,298 A * 12/1997 Sandstrom ..... E01C 19/286 404/117
5,797,699 A * 8/1998 Blancke ..... E01C 19/288 404/117
6,402,424 B2 * 6/2002 Mitsui ..... E01C 19/286 404/117
6,750,621 B2 * 6/2004 Gandrud ..... E01C 19/288 318/114
8,827,593 B1 * 9/2014 Oetken ..... E01C 19/28 404/117
2003/0026657 A1 * 2/2003 Gasper ..... E01C 19/286 404/117
2003/0048082 A1 3/2003 Gandrud
2003/0223816 A1 * 12/2003 Potts ..... E01C 19/288 404/117
2007/0120515 A1 * 5/2007 Clary ..... B06B 1/166 318/625
2016/0076205 A1 3/2016 Corcoran et al.

FOREIGN PATENT DOCUMENTS

DE 10321666 12/2003
DE 102009055950 6/2011
JP 08-105011 4/1996
JP 2003-531324 10/2003
JP 2005-279364 10/2005
WO 2011064367 6/2011

OTHER PUBLICATIONS

Japanese Office Action for Japanese patent application No. 2017-105334, dated May 9, 2018; 5 pages.

* cited by examiner

SOIL COMPACTOR AND METHOD FOR OPERATING A SOIL COMPACTOR

BACKGROUND

The present invention relates to a soil compactor, which may be used, for example, in road construction, to compact a prepared substrate or to compact the asphalt applied on the prepared and compacted substrate.

A soil compactor of this type is known from WO 2011/064367 A2. The soil compactor has two compacting rollers which are rotatable about respective roller rotation axes. The two compacting rollers are arranged following one another in a longitudinal direction or also a movement direction of the soil compactor with roller axes of rotation essentially parallel to one another at least during straight line travel. At least one of the compacting rollers is a divided compacting roller and has two basically independent rotatable roller areas sequential to another in the direction of the roller axis of rotation of this compacting roller. A vibration excitation device is assigned to these two adjacent and independently drivable roller areas rotatable, for example, by roller drives respectively assigned to them, said vibration excitation device comprising an inertial mass arrangement with inertial masses rotatably drivable about a respective inertial mass axis of rotation in each of the roller areas. A common inertial mass drive is assigned to the two inertial mass arrangements of the two compacting roller areas. Said inertial mass drive directly drives one of the inertial mass arrangements and drives the other inertial mass arrangement via a planetary gear. The use of the planetary gear guarantees that even when the two compacting roller areas rotate about the common compacting roller axis of rotation at different speeds from one another, for example, when traveling through curves, the two inertial mass arrangements of the compacting roller areas function in phase with one another, thus, upon the occurrence of a speed difference, no phase shift occurs in the vibrating movement of the two inertial mass arrangements and thus no phase shift occurs in the vibrating movement of the compacting roller areas excited to implement a vibrating movement by these inertial mass arrangements.

CN 103603258 B discloses a method with which it is to be guaranteed that, in a soil compactor that has two compacting rollers excitable to implement a vibrating movement, no overlapping occurs of the vibrations caused by the vibrating movements. For this purpose, the vibration frequencies of the two compacting rollers excited to vibration are detected and adjusted in such a way that the occurrence of beating caused by a difference existing between these vibration frequencies is largely prevented. The compacting rollers of the soil compactor thus operated are thus excited to implement vibrating movements with vibration frequencies that differ from one another.

BRIEF DESCRIPTION

It is the object of the present invention to provide a soil compactor and a method for operating a soil compactor with which the occurrence of excessive operating noises, caused by compacting rollers excited to implement a vibrating movement, is prevented, without impairing the compacting operation.

According to the invention, this problem is solved by a soil compactor, comprising:

at least two vibrating compacting rollers rotatable about a respective roller axis of rotation, a vibration excitation arrangement assigned to each vibrating compacting roller for generating a vibrating movement of the vibrating compacting rollers, a vibration detection arrangement assigned to each vibrating compacting roller for providing a vibration variable representing the vibrating movement of each vibrating compacting roller, a control unit for controlling at least one vibration excitation arrangement, based on the vibration variables provided with respect to the vibrating compacting rollers in such a way that the vibrating movements of the vibrating compacting rollers have a predefined phase shift to one another.

The vibrating compacting rollers used in a soil compactor designed according to the invention may be two compacting rollers, provided sequentially to one another in a soil compactor longitudinal direction, for example, in a front area and a rear area of the soil compactor, which consequently rotate about different roller axis of rotation, nevertheless essentially parallel at least in straight line travel; there may, however, also be two compacting roller areas sequential to one another in the direction of a compacting roller axis of rotation and consequently rotatable about the same compacting roller axis of rotation.

By monitoring the vibrating movements of these vibrating compacting rollers and the operation or control of the vibration excitation arrangements of the same in such a way that the phase offset of the vibration movements assumes a predefined magnitude with respect to one another, then this phase offset may be actively influenced such that noises or vibrations caused by overlapping of the vibrating movements may be counteracted by corresponding adjustment, if necessary also adaption or shifting of the phase angle. It is thereby not fundamentally necessary to change the vibration frequency at at least one of the vibrating compacting rollers, so that each vibrating compacting roller may be excited to vibrate with the optimal frequency for the compacting operation to be undertaken, for example, all or at least one part of the vibrating compacting rollers are excited to vibrate at the same frequency or are excited to a vibrating movement at the same frequency, however phase offset.

The vibration magnitude preferably has an essentially periodic curve.

In a configuration for providing information about the vibrating movements of the vibrating compacting rollers, which is particularly advantageous as it is easy and operationally safe to establish, it is proposed that at least one vibration excitation arrangement comprises at least one accelerometer for detecting an acceleration of the assigned vibrating compacting roller, preferably for detecting an acceleration of the assigned vibrating compacting roller in a vertical direction and/or in a circumferential direction.

Each vibration excitation arrangement may comprise an inertial mass arrangement and an inertial mass drive driving the same to move.

Since these types of soil compactors are generally hydraulically driven and thus a hydraulic system is basically available, it is further proposed that each inertial mass drive comprises a drive motor, preferably a hydraulic motor, and that each inertial mass arrangement comprises at least one inertial mass, which is drivable by the assigned drive motor to rotate about an inertial mass axis of rotation.

Each drive motor is preferably a hydraulic motor, and at least one hydraulic pump is additionally preferably provided in order to provide the pressurized fluid necessary for operating the hydraulic motors or to supply the hydraulic motors.

In one embodiment variant that is structurally particularly easy to implement, it is proposed that a hydraulic pump is provided for supplying all hydraulic motors with pressurized fluid, and that at least one hydraulic motor is a variable hydraulic motor. Reference is made to the fact that in the meaning of the present invention, a variable hydraulic motor is a hydraulic motor which is variable in speed due to corresponding control of the same, for example by adjusting the absorption volume.

In one alternative embodiment, it is proposed that a hydraulic pump is provided associated with each hydraulic motor, and that in at least one, preferably each, pair made of a hydraulic motor and hydraulic pump, the hydraulic pump and/or the hydraulic motor is variable. This embodiment variant is particularly suitable if the vibrating compacting rollers are provided in different areas, thus for example at a front area and a rear area of a soil compactor so that each of the vibrating compacting rollers may be operated using a completely independent system. In order to thereby be able to carry out the phase matching, in at least one of the vibrating compacting rollers or in the pair made of a hydraulic motor and hydraulic pump provided in association with the same, either the hydraulic pump or the hydraulic motor or both are variable. Variability in association with a hydraulic pump also means that this hydraulic pump is designed to change the amount and/or the pressure of the pressurized fluid delivered by the same, for example by corresponding adjustment of the conveying volume, in order to cause in this way a corresponding operational change in the hydraulic motor as well.

The previously stated problem is additionally solved by a method for operating a soil compactor having at least two vibrating compacting rollers, preferably having the design according to the invention, wherein the vibrating compacting rollers are rotatable about respective roller axes of rotation and are excitable to implement a vibrating movement by a respective vibration excitation arrangement, wherein vibration excitation arrangements assigned to different vibrating compacting rollers are controlled in such a way that the vibrating movements of these vibrating compacting rollers have a predetermined, basically changeable phase offset.

In order to be able to acquire knowledge about the vibration state of a respective vibrating compacting roller, and in order to be able to adjust the phase angle of the respective vibrating movement based thereon, it is further proposed that the acceleration of each vibrating compacting roller is detected, and that, based on the accelerations of the vibrating compacting rollers, at least one vibration excitation arrangement is controlled in such a way that the accelerations of these vibrating compacting rollers have the predetermined phase offset to one another.

To adjust the phase angles of the vibrating movements of different vibrating compacting rollers, and thus the phase offset with respect to one another or to change the phase offset, it may be provided that each vibration excitation arrangement comprises an inertial mass arrangement with at least one inertial mass drivable to rotate about an inertial mass axis of rotation and an inertial mass drive, and that to change the phase offset of the vibrating movements of the vibrating compacting rollers with respect to one another, at least one inertial mass in at least one vibration excitation arrangement is driven by the assigned inertial mass drive in a phase matching operating phase to rotate with a speed that differs with respect to a base rotational state. In this approach, if it is initially determined that the vibrating compacting rollers vibrating, for example, at the same frequency, have a disadvantageous phase offset of the vibrating movements, then, starting from a base rotational state of a respective inertial mass, thus a state in which said inertial mass rotates with a base speed provided for the base rotational state, the speed of one of the inertial masses may be changed temporarily in a phase matching operating phase, for example, this inertial mass may be rotated at somewhat greater speed, which temporarily also leads to a change of the excitation frequency, however, essentially causes a change of the phase offset of the vibrations. If the desired or predetermined phase offset is achieved, then this inertial mass is returned again to the base rotational state, thus is driven to rotate with the base speed so that, for example, two or all vibrating compacting rollers vibrate or are excited to vibrate with the same frequency; however, the phase offset of the vibrating movements to one another lies in the desired range.

BRIEF DESCRIPTION OF THE DRAWINGS

The present invention is subsequently described in detail with reference to the appended figures.

DETAILED DESCRIPTION

Figure 1:
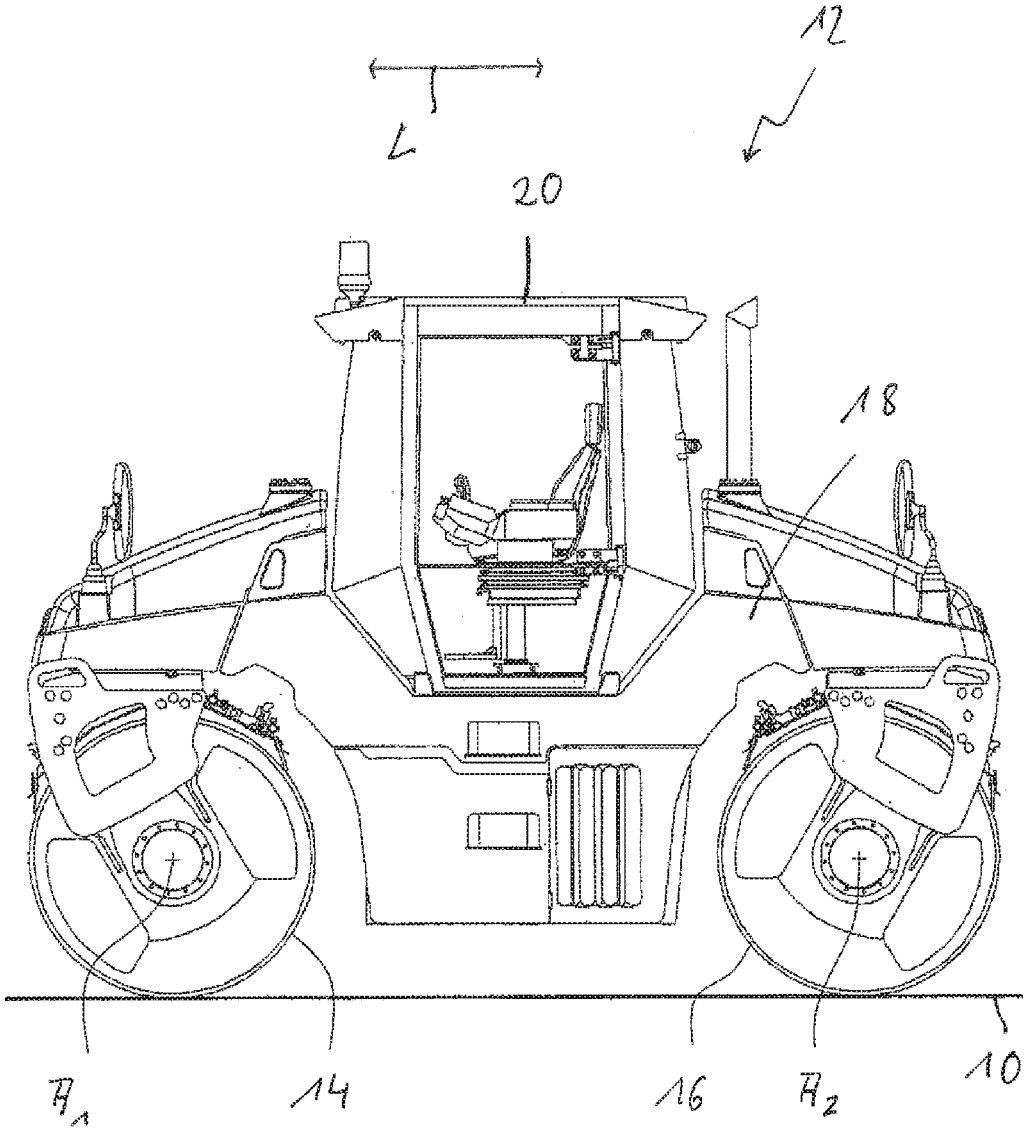
FIG. 1 shows a soil compactor with two vibrating compacting rollers in a side view.

A soil compactor for compacting a substrate 10 is shown in FIG. 1, referenced as a whole with 12. Soil compactor 12 has two vibrating compacting rollers 14, 16 arranged sequentially in a soil compactor longitudinal direction L, which are rotatable about roller axes of rotation $A_1$, $A_2$ spaced apart from one another in soil compactor longitudinal direction L. A roller drive may be assigned to at least one of these two vibrating compacting rollers 14, 16 in order to move soil compactor 12 to implement compacting processes, wherein in the course of this movement, two vibrating compacting rollers 14, 16 rotate about their roller axes of rotation $A_1$, $A_2$ and thereby roll over substrate 10. To steer soil compactor 12, vibrating compacting rollers 14, 16, generally referred to as tires, may be pivotable at a compactor frame 18, referenced with 18 and also having a driver's cab 20, about, for example, pivot axes oriented essentially horizontally.

Figure 2:
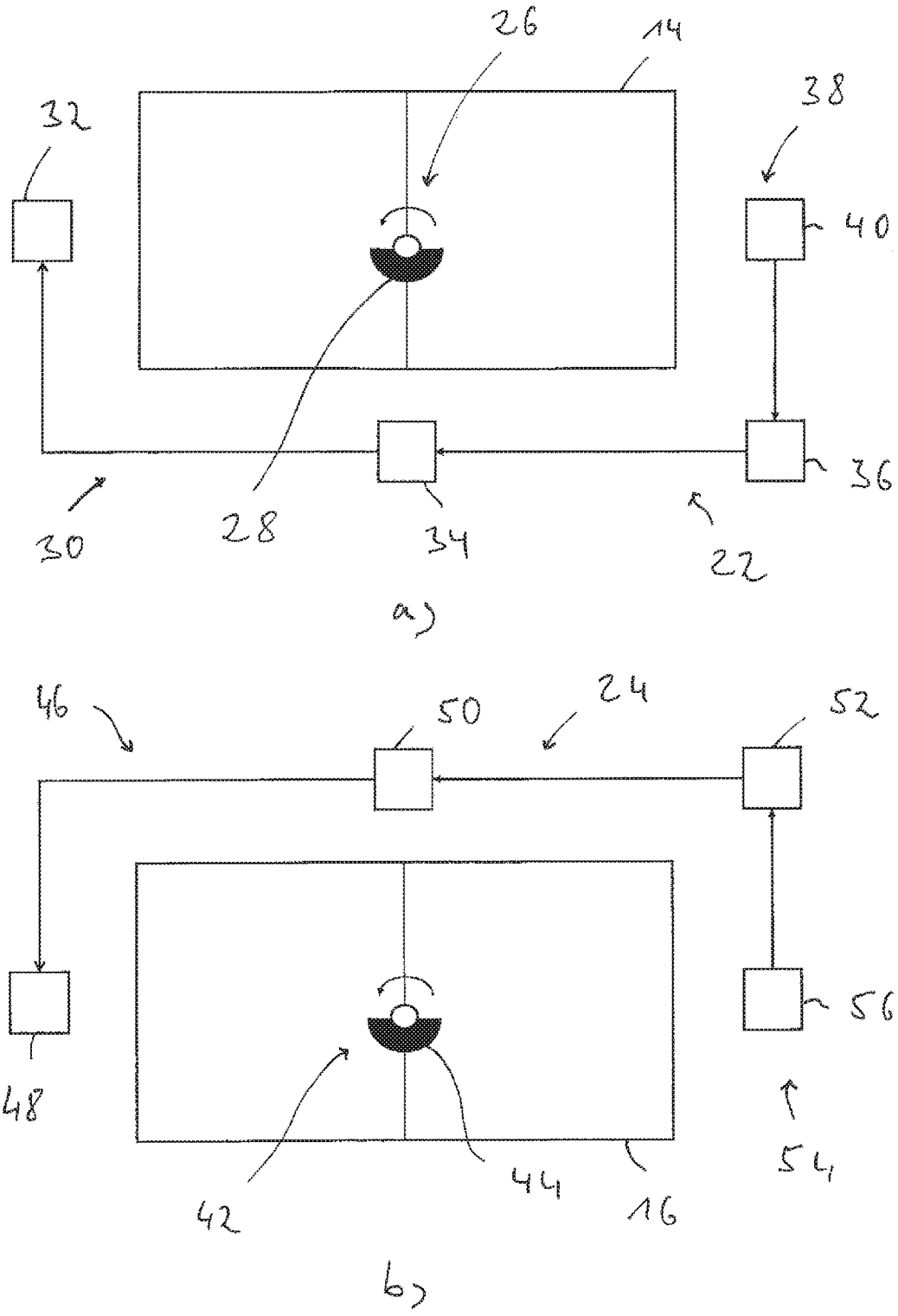
FIG. 2 shows in perspectives a) and b) the two vibrating compacting rollers of the soil compactor from FIG. 1 with the assigned vibration excitation arrangements.

FIG. 2 shows in two depictions a) and b) two vibrating compacting rollers 14, 16 with a vibration excitation arrangement 22 or 24 respectively assigned. Vibration excitation arrangement 22 of vibrating compacting roller 14 comprises an inertial mass arrangement 26 arranged, for example, in the interior of vibrating compacting roller 14 and having at least one inertial mass rotatable about an inertial mass axis of rotation 28.

It should be assumed, for example, that vibration excitation arrangement 22, likewise also vibration excitation arrangement 24, is provided to excite respectively assigned vibrating compacting roller 14, 16 to implement a vibrating movement, thus an vibrating movement back and forth oriented essentially in a vertical direction or orthogonal to the substrate to be compacted. In this case, the at least one inertial mass is generally rotatable about an inertial mass axis of rotation which also essentially corresponds to the axis of rotation of the vibrating compacting roller.

In order to set at least one inertial mass 28 of inertial mass arrangement 26 into motion, thus to drive it to rotate about the respective inertial mass axis of rotation, by way of example here roller axis of rotation $A_1$, vibration excitation arrangement 22 additionally has an inertial mass drive 30. Inertial mass drive 30 comprises in turn a drive motor 32, designed as a hydraulic motor in the example shown, and a hydraulic pump 34 supplying this drive motor 32 or hydraulic motor with pressurized fluid.

Inertial mass drive 30 is controlled by a control arrangement, referenced as a whole with 36, which controls, for example, hydraulic pump 34 in order to drive the output of pressurized fluid at a predefined output amount or a predefined pressurized fluid, so that drive motor 32 or the hydraulic motor is correspondingly also set into operation and drives the at least one inertial mass 28 to rotate. Hydraulic pump 34 in the example shown in FIG. 2 is thereby a variable hydraulic pump, thus a hydraulic pump whose conveying amount or conveying pressure is adjustable. An increase of the pressurized fluid conveying amount or of the pressure of the pressurized fluid emitted by hydraulic pump 34 leads to a corresponding increase of the speed of a motor shaft (not shown) of the hydraulic motor or drive motor 32 and correspondingly also to a higher speed of the at least one inertial mass 28, with the result that compacting roller 14 set thereby into vibrating movement is excited to vibrate at a correspondingly changed frequency or vibrates at a corresponding frequency.

To detect this vibrating movement of vibrating compacting roller 14, a vibration detection arrangement, referenced as a whole with 38, is provided. This may, for example, comprise at least one accelerometer 40 which detects, for example, the acceleration of compacting roller 14 in the area of roller axis of rotation $A_1$, for example in the area of a roller bearing, wherein, in the embodiment depicted of a vibrating compacting roller 14 excited to vibration, accelerometer 40 is designed essentially to detect a vibrating movement in that movement direction in which compacting roller 14 is excited into vibrating movement, thus essentially in an up and down direction. Accelerometer 40 provides an acceleration signal, representing the vibrating movement of vibrating compacting roller 14 and depicting a vibration variable, to control arrangement 36. In the subsequently described way, control arrangement 36 may control inertial mass drive 30, in particular hydraulic pump 34, based on this acceleration signal representing a vibration variable, in order to influence the operation of inertial mass arrangement 26 in a corresponding way.

With reference to vibrating compacting roller 16 depicted in FIG. 2*b*), it is stated that vibration excitation arrangement 24 assigned to the same also comprises an inertial mass arrangement 42 with at least one inertial mass 44 rotatable about an inertial mass axis of rotation, wherein in this example as well, vibration excitation arrangement 24 is designed to generate a vibrating movement of vibrating compacting roller 16 and consequently the at least one inertial mass 28 is rotated about an inertial mass axis of rotation generally corresponding to roller axis of rotation $A_2$. To generate this rotational movement, an inertial mass drive 46 with a drive motor 48 designed as a hydraulic motor and a variable hydraulic pump 52 is assigned to inertial mass arrangement 42. This hydraulic pump is controlled by a control arrangement 52. Control arrangement 52 may be designed separately from control arrangement 36, yet may be connected to the same for the exchange of information in order to be able to operate two vibration excitation arrangements 22, 24 in a way coordinated with one another. Two control arrangements 36, 52 may, however, also basically be combined in one and the same control arrangement and be designed to control two out-of-balance drives 30, 46.

Reference is made to the fact that these types of control arrangements, used in the context of a soil compactor according to the invention, may be provided in a control device or designed as such. They may, for example, comprise processors designed as microprocessors or microcontrollers and may be programmed permanently or as rewritable with programs suitable for executing the control measures. They may have input connections to which the assigned sensors, in particular accelerometers, may be connected to supply the output signals of the same, and may have output connections to which control lines leading to the respective system areas to be controlled, for example the hydraulic pumps or hydraulic motors, may be connected.

A vibration detection arrangement 54 with at least one accelerometer 56 is also assigned to vibrating compacting roller 16, said accelerometer outputs an acceleration signal, corresponding to the vibrating movement of compacting roller 16, which movement is cause by at least one inertial mass 44 set into rotation, as a vibration variable to control arrangement 52. In this case as well, for example, accelerometer 56 may detect the acceleration of compacting roller 16 in the area of a roller bearing of the same. Reference is be made here, however, that, for example accelerometers provided in the interior of vibrating compacting rollers 14, 16, for example on a roller cover, may be used to detect the acceleration and consequently the vibrating movement of vibrating compacting roller 14, 16. In addition, multiple accelerometers of this type may be respectively assigned to vibrating compacting rollers 14, 16, in order to respectively generate a vibration variable from their output signals, said vibration variable representing the vibrating movement of said vibrating compacting roller 14, 16, for example, in control arrangements 36, 52, and to use the vibration variable to control inertial mass drives 30, 46.

Figure 3:
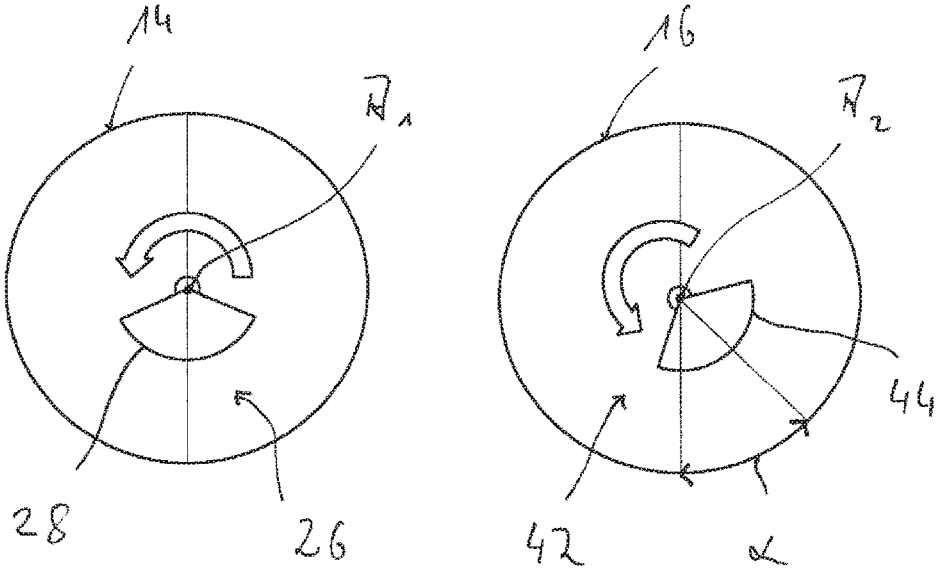
FIG. 3 shows the two vibrating compacting rollers with the assigned inertial masses in a schematic side view.

FIG. 3 principally shows a depiction of two vibrating compacting rollers 14, 16 with inertial mass arrangements 26 or 42 assigned to the same. Two inertial masses 28, 44, which may be set into rotation about the respective compacting roller axis of rotation $A_1$ or $A_2$, are depicted such that they have an angle offset a to one another; however basically rotated in the same direction.

Figure 4:
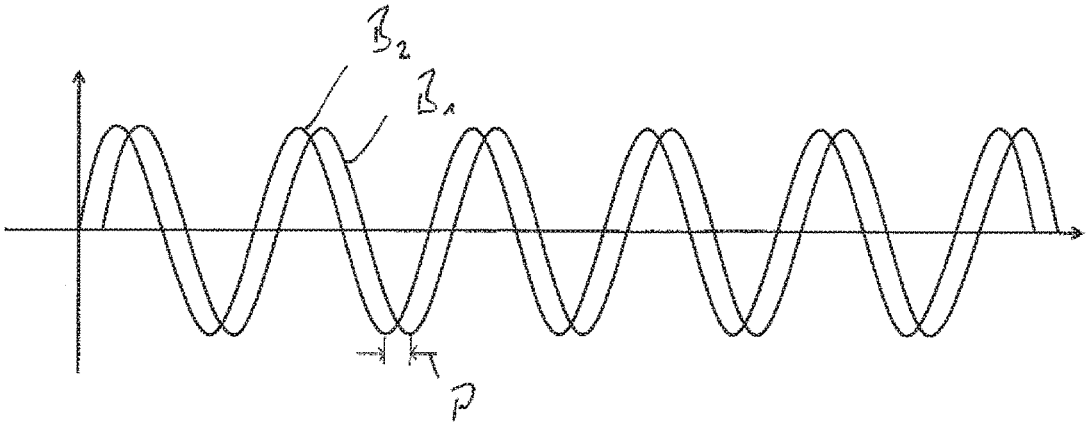
FIG. 4 shows the temporal curve of the accelerations of the vibrating compacting rollers occurring in the vibrating compacting rollers of the soil compactor from FIG. 1.

Acceleration signals $B_1$, $B_2$ are generated by accelerometers 40, 56 detecting the vibrating movements of vibrating compacting rollers 14, 16, said acceleration signals are assigned to inertial masses 28, 44 positioned thus relative to one another, the curve of said acceleration signals is shown in FIG. 4, in particular in the case that two vibration excitation arrangements 22, 24 are essentially structurally identical to one another and basically identical, thus in particular are operated with the same speed as their inertial masses 28, 44, then two acceleration signals $B_1$ and $B_2$, which represent the temporal curve of the accelerations of vibrating compacting rollers 14, 16, have the same frequency and essentially also the same amplitude of acceleration. However, it is clear that, a phase offset P is present caused by offset a of two inertial masses 28, 44, reference being made here to the angular position of the center of mass of respective inertial masses 28, 44. The size of this phase offset P may be adjusted according to the principles of the present invention so that no beating or other vibration excitations leading in particular to excessive noises may occur due to overlapping of the vibrating movements of two vibrating compacting rollers 14, 16. Phase offset P may, for example, be adjusted depending on the operation of the two vibration excitation arrangements, thus, for example, depending on the speed of inertial masses 28, 44. Alternatively, a sensor arrangement might also be provided on soil compactor 10, which is designed to detect vibrations, for example, sound or structural vibration in the area of soil compactor 10 itself, and thus provides a feedback signal when, during operation of two vibration excitation arrangements 22, 24, there is a risk that an excessive vibration excitation of other system areas occurs due to overlapping of the vibrating movements of two vibrating compacting rollers 14, 16. In this case, inertial mass arrangements 26, 42 may be acted upon in order to influence phase offset P of the vibrating movements caused thereby at two vibrating compacting rollers 14, 16, and thus to counteract an undesired overlapping of this type.

To change phase offset P, the method may proceed, for example, such that starting from a base rotational state of two inertial mass arrangements 26, 42 or of inertial masses 28, 44 of the same, at least one of vibration excitation arrangements 22, 24 is controlled by control arrangement 36 or 52 of inertial mass drive 30 or 46 in such a way that said inertial mass drive functions temporarily, thus in a phase matching operating phase, with a changed speed of respective drive motor 32 or 48. For example, the speed may be increased to correspondingly also increase the speed of inertial mass 28 or 44 thereby set into rotation. An increased speed of one of two inertial masses 28, 44 does indeed lead temporarily to an increased excitation frequency; however, it leads in particular to a change of angle $\alpha$ shown in FIG. 3. This operation with changed speed in the phase matching operation phase is continued until desired phase offset P is achieved. If this is the case, then that vibration excitation arrangement 22 and/or 24, which was previously driven at a changed speed with respect to the base rotational state, thus the base speed, is again controlled such that the assigned inertial mass arrangement or its inertial mass rotates again at the base speed, thus in the base rotational state, and consequently two inertial mass arrangements 26, 42 excite assigned vibrating compacting rollers 14, 16 to vibrate again at the frequency corresponding to the base rotational state, for example, to vibrate at the same frequency with one another.

This type of adjustment of phase offset P of the vibrating movements of two vibrating compacting rollers 14, 16 may be carried out repeatedly or continuously as necessary during operation of soil compactor 12, for example, within the context of a control loop in order to guarantee in this way that the occurrence of undesired vibration excitations caused by vibration overlapping is prevented during a changing operating state or operating condition of soil compactor 12, for example, at increasingly strongly compacted substrate and corresponding change of the vibration behavior of vibrating compacting rollers 14, 16.

Although a phase offset P different from zero is shown in FIG. 4, a phase offset P not different from zero may also be advantageous for preventing an adverse overlapping of the vibrating movements, depending on the operating state of soil compactor 12, for example, also depending on the respective vibration amplitudes of vibrating compacting rollers 14, 16. This type of phase offset with the value of zero, which may be adjusted by corresponding control of vibration excitation arrangements 22, 24, is however also basically changeable, thus is also a phase offset in the meaning of the present invention. Furthermore, according to the principles of the present invention, a predetermined phase offset may be defined in that a phase offset, which is disadvantageous with respect to the vibration excitation or vibration overlapping, is not adjusted, or a change is introduced away from this type of undesirable phase offset. If, for example, a phase offset with the value zero, thus an in-phase vibration excitation of the two vibrating compacting rollers, is disadvantageous, then the adjustment of a phase offset arbitrarily different from zero may be interpreted as providing a predetermined phase offset in the meaning of the present invention. Thus, a predetermined phase offset in the meaning of the present invention is also defined by a value range of the phase offset. It is fundamentally relevant for the present invention, that at least one of the vibration excitation arrangements may be influenced in order to be able to actively cause a change of the phase offset.

Figure 5:
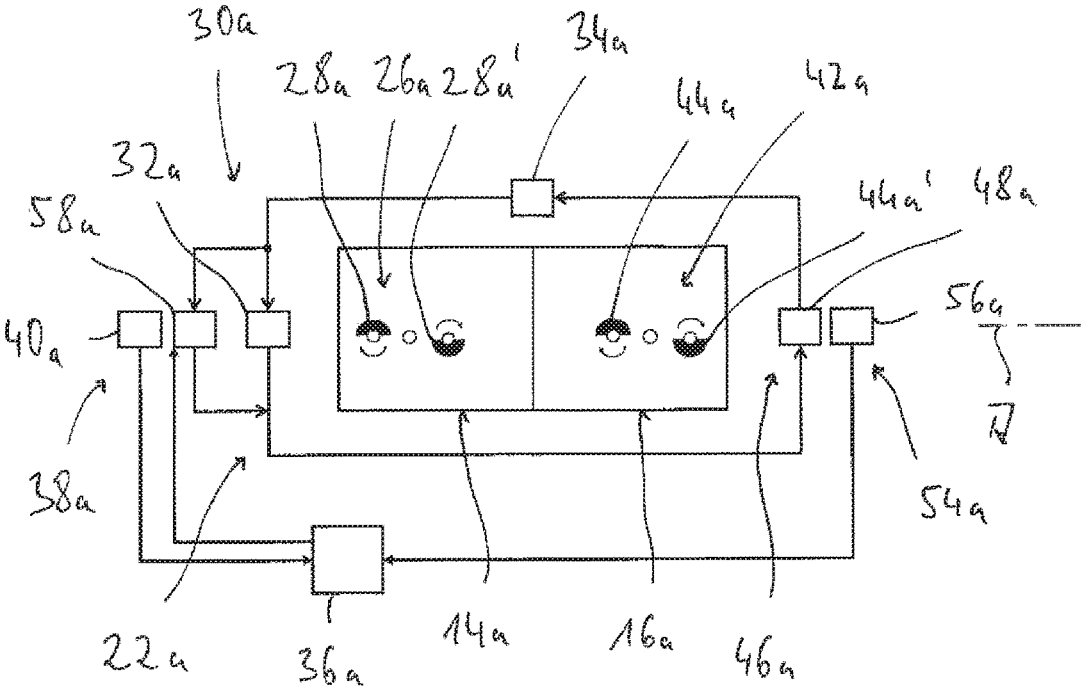
FIG. 5 shows a principle representation of two adjacent vibrating compacting rollers rotatable about a common roller axis of rotation with the assigned vibration excitation arrangements.

One alternative embodiment version is shown in FIG. 5. FIG. 5 shows two vibrating compacting rollers 14*a*, 16*a* sequential to one another in the direction of a compacting roller axis A and consequently rotatable about the same compacting roller axis of rotation A. A vibration excitation arrangement 22*a*, 24*a* with an inertial mass arrangement 26*a*, 42*a* respectively and an inertial mass drive 30*a*, 46*a*, is assigned to each vibrating compacting roller 14*a*, 16*a*. In the example shown in FIG. 5, vibration excitation arrangements 22*a*, 24*a* are designed to excite vibrating compacting rollers 14*a*, 16*a* to implement an oscillation movement, thus a back and forth movement about roller axis of rotation A, which movement is overlapped by the continuous rotational movement about this roller axis of rotation A occurring during forward movement of a soil compactor. For this purpose, each inertial mass arrangement 26*a*, 42*a* has, e.g. at least two inertial masses 28*a*, 28*a*', or 44*a*, 44*a*' which are drivable for rotation about respective inertial mass axes of rotation eccentric to roller axis of rotation A yet parallel to the same. Reference is made here that the structure of this type of inertial mass arrangements 22*a*, 44*a* is known in the prior art, for example from WO 2011/064367 A2 discussed at the outset.

Inertial mass drives 30*a*, 46*a*, associated with each of inertial mass arrangements 22*a*, 42*a*, comprise a drive motor 32*a*, 48*a* designed in turn as a hydraulic motor. One common hydraulic pump 34*a* is assigned to two drive motors 32*a*, 48*a*.

In order to be able to provide vibration variables, associated with two vibrating compacting rollers 14*a*, 16*a* and representing their vibrating movement, a vibration detection arrangement 38*a* or 54*a* is respectively provided, in each case comprising, for example, one or at least one accelerometer 40*a* or 56*a*. These are designed in the case depicted for detecting a peripheral acceleration of assigned vibrating compacting roller 14*a*, 16*a*, and may, for example be provided on the inner periphery of a respective roller cover or another component or aggregate rotating with the vibrating compacting roller about roller axis of rotation A. The accelerometers 40*a*, 56*a* supply their acceleration signals to control arrangement 36*a*. Control arrangement 36*a* is basically designed to control two vibration arrangements 22*a*, 24*a* to set these into operation. For this purpose, for example, control arrangement 36*a* may be in a control connection to hydraulic pump 34*a*. Furthermore, in the embodiment shown, control arrangement 36*a* is in control connection to drive motor 32*a* of vibration excitation arrangement 22*a*. For this purpose, for example, drive motor 32*a* designed as a variable hydraulic motor in this embodiment may have a bypass valve 58*a* which is under the control of control arrangement 36*a* and is able, according to the control, to adjust the amount of pressurized fluid used in hydraulic motor 32*a*, thus to adjust its absorption volumes such that an adjustment of the speed of a motor shaft of hydraulic motor 32*a* is also correspondingly carried out.

To set or adjust phase offset P, the operation of inertial mass drive 30*a* may be influenced in the previously described way, while, for example, inertial mass drive 46*a* of vibration excitation arrangement 24*a* is allowed to operate unchanged, in particular, the hydraulic pump also remains unchanged in operation. Basically, however, hydraulic pump 34*a* in this embodiment may be designed with variable conveying volumes in order to be able to thus also change the speed of hydraulic motor 48*a*, or to change the speeds of two hydraulic motors or drive motors 32*a*, 48*a* through correspondingly changed control of hydraulic pump 34*a*. The drive motor or hydraulic motor 48*a* may also be designed as a variable motor.

The configuration of vibration excitation arrangements 22*a*, 24*a*, shown in FIG. 5 with a common hydraulic pump 34*a* acting for two drive motors 32*a*, 46*a*, is particularly advantageous if two vibrating compacting rollers 14*a*, 16*a* are arranged adjacent to one another and thus are easily coupled to this hydraulic system. If the two vibrating compacting rollers to be coordinated in their phase angles are provided at different areas of a soil compactor, as is shown in FIG. 1, hydraulic systems decoupled from one another are advantageously used.

Soil compactor 12 of FIG. 1 may also be designed in such a way that in one of the end areas thereof, vibrating compacting rollers 14*a*, 16*a*, shown in FIG. 5, are provided adjacent to one another, whereas at the other end area, a compacting roller is provided which is basically not excited to implement a vibrating movement. Basically, however, a vibrating compacting roller or two adjacent vibrating compacting rollers may also be used such that more than two vibrating compacting rollers are also used on one and the same soil compactor and may be coordinated to one another with respect to the phase angle of their vibration excitations.

The invention claimed is:

1. A soil compactor, comprising:

two vibrating compacting rollers arranged following each other in the direction of a roller axis of rotation and being rotatable about the same roller axis of rotation, a vibration excitation arrangement assigned to each one of the at least two vibrating compacting rollers for generating a vibrating movement of the at least two vibrating compacting rollers, a vibration detection arrangement assigned to each one of the two vibrating compacting rollers for providing vibration variables representing the vibrating movement of each one of the two vibrating compacting rollers, wherein the vibration detection arrangement is in association with each one of the two vibrating compacting rollers and includes at least one accelerometer for detecting an acceleration of each one of the two vibrating compacting rollers, a sensor arrangement assigned to the soil compactor for providing a feedback signal indicative of a structural vibration of the soil compactor, and a control unit for controlling one of the vibration excitation arrangements based on the vibration variables provided by the vibration detection arrangement with respect to the vibrating compacting rollers in such a way that the vibrating movements of the two vibrating compacting rollers have a predefined phase offset relative to one another and for receiving the feedback signal from the sensor arrangement for controlling the one of the vibration excitation arrangements, based on the feedback signal, such as to act on the predefined phase offset of the vibrating movements of the two vibrating compacting rollers with respect to one another, wherein each one of the vibration excitation arrangements assigned to the two vibrating compacting rollers comprises an inertial mass arrangement and an inertial mass drive, each one of the inertial mass drives comprising a drive motor, and each one of the inertial mass arrangements comprising at least one inertial mass drivable by one of the drive motors to rotate about an inertial mass axis of rotation, wherein each drive motor is a hydraulic motor, wherein only one hydraulic pump is provided for supplying all the hydraulic motors serially connected to the hydraulic pump with pressurized fluid, and wherein, for adjusting the phase offset of the vibrating movements of the vibration excitation arrangements assigned to the two vibrating compacting rollers, the control unit is arranged for controlling a bypass valve associated with the hydraulic motor of the one of the vibration excitation arrangements for adjusting the amount of pressurized fluid used in this hydraulic motor.

2. The soil compactor according to claim 1, wherein a vibration variable of the vibration variables has an essentially periodic curve.

3. The soil compactor according to claim 1, wherein all pressurized fluid passing through a first one of the hydraulic motors serially connected to the hydraulic pump also passes through a second one of the hydraulic motors.

4. The soil compactor according to claim 1, wherein the hydraulic pump is a variable hydraulic motor.

5. A method for operating a soil compactor having at least two vibrating compacting rollers, wherein the at least two vibrating compacting rollers are arranged following each other in the direction of a roller axis of rotation, rotatable about the same roller axis of rotation and are excitable to implement a vibrating movement by a respective vibration excitation arrangement, comprising:

detecting vibration variables by a vibration detection arrangement assigned to each one of the two vibrating compacting rollers;

representing the vibrating movement of each of the vibrating compacting rollers;

controlling one of the vibration excitation arrangements based on the vibration variables;

detecting a structural vibration of the soil compactor;

providing a feedback signal indicative of the structural vibration of the soil compactor;

controlling one of the vibration excitation arrangements assigned to each of the two vibrating compacting rollers based on the vibration variables provided by the vibration detection arrangement with respect to the vibrating compacting rollers in such a way that the vibrating movements of the two vibrating compacting rollers have a predefined phase offset relative to one another providing each one of the vibration excitation arrangements assigned to the two vibrating compacting rollers with an inertial mass arrangement and an inertial mass drive, wherein each one of the inertial mass drives comprises a drive motor, and each one of the inertial mass arrangements comprises at least one inertial mass;

driving each of said at least one inertial mass by one of the drive motors to rotate said inertial mass about an inertial mass axis of rotation, wherein each rive motor is a hydraulic motor;

supplying all the hydraulic motors, which are serially connected to only a single hydraulic pump, with pressurized fluid;

adjusting the phase offset of the vibrating movements of the vibration excitation arrangements assigned to the two vibrating compacting rollers; and controlling a bypass valve associated with the hydraulic motor of the one of the vibration excitation arrangements for adjusting the amount of pressurized fluid used in the hydraulic motor.

* * * * *